US005110715A

United States Patent [19]

Wernicke et al.

[11] Patent Number: 5,110,715

[45] Date of Patent: May 5, 1992

[54] PHOTOGRAPHIC REVERSAL PROCESS

[75] Inventors: Ubbo Wernicke, Cologne; Werner Berthold, Leverkusen; Helmut Häseler, Leverkusen; Gustav Tappe, Leverkusen, all of Fed. Rep. of Germany

[73] Assignee: Agfa Gavaert Aktiengesellschaft, Leerkusen, Fed. Rep. of Germany

[21] Appl. No.: 419,584

[22] Filed: Oct. 10, 1989

[30] Foreign Application Priority Data

Oct. 20, 1988 [DE] Fed. Rep. of Germany ..... 3835661
Dec. 22, 1988 [DE] Fed. Rep. of Germany ..... 3843264

[51] Int. Cl.[5] ..... G03C 7/46; G03C 5/50

[52] U.S. Cl. ..... 430/379; 430/380; 430/382; 430/407

[58] Field of Search ..... 430/379, 380, 382, 407

[56] References Cited

U.S. PATENT DOCUMENTS

| | | | |
|---|---|---|---|
| 3,295,975 | 1/1967 | Meckl et al. | 96/55 |
| 3,883,354 | 5/1975 | Molenda | 96/59 |
| 4,194,911 | 3/1980 | Huffman et al. | 430/357 |
| 4,258,117 | 3/1981 | Morgan et al. | 430/214 |
| 5,006,439 | 4/1991 | Wernicke et al. | 430/379 |

*Primary Examiner*—Marion E. McCamish
*Assistant Examiner*—Janis L. Dote
*Attorney, Agent, or Firm*—Connolly and Hutz

[57] ABSTRACT

The present invention relates to a photographic reversal process for the production of positive photographic images by imagewise exposure of the photosensitive material containing at least one silver halide emulsion layer, black-and-white first development of the material, chemical fogging or diffuse second exposure and subsequent color development, characterized in that 1. at least one N,N-dialkyl-p-phenylenediamine derivative is used as sole developer in the first development,
2. the first development bath contains at least one compound which prevents the developer oxidation product formed during the first development from reacting with the color couplers present in the color photographic reversal material to form image dyes,
3. the silver halide emulsion layers of the photographic material have a chloride content of at least 80 mol-%, is particularly suitable for the rapid development of reversal materials by elimination of or shortening of the washing step between first and second developer without any disadvantages arising in regard to the quality of the dye images produced by this process.

10 Claims, No Drawings

PHOTOGRAPHIC REVERSAL PROCESS

This invention relates to a process for processing photographic reversal materials in which the washing step between the black-and-white and color development baths is largely eliminated.

In the photographic reversal process, a positive colored image is produced using a color transparency by exposure of a negatively working color reversal paper by a special reversal development. The color reversal paper comprises at least one blue-sensitive silver halide layer containing a yellow coupler, at least one green-sensitive silver halide layer containing a magenta coupler and at least one red-sensitive silver halide layer containing a cyan coupler.

Typical reversal processing by the chromogenic color process comprises at least six steps, namely:

First development = black-and-white negative development. The silver halide exposed imagewise during shooting is developed by a first developer to a black-and-white negative. Metol-hydroquinone or phenidone-hydroquinone developers are generally used.

Intermediate washing = removal of the first developer to avoid redevelopment in the color development bath.

Diffuse second exposure or chemical fogging. All the silver halide which was not developed in the first developer is made developable.

Color development = development of the silver halide activated by the second exposure or chemical fogging to silver and dye formation. The dyes are formed in corresponding quantities from color coupler and the developer oxidation product formed proportionally to the silver halide reduced in the color developer.

Bleaching and fixing or bleaching/fixing = dissolving out all the silver developed in the first and color development to leave a positive dye image.

Final washing or stabilizing bath = washing out of chemicals and stabilizing of image dyes and image surface.

The present state of the art is characterized by the Kodak R3 process.

The total processing time in this process is 600 seconds, of which 75 seconds is taken up by the first development, 90 seconds by the indispensable two-stage cascade washing between first and color developer and 135 seconds by color development.

The remaining time is taken up by bleaching/fixing and washes.

This reversal process could be made much easier, faster and more efficient if it were possible to eliminate washing between first and color development or considerably to shorten the washing times. However, if the conventional process were to be carried out without washing, black-and-white redevelopment would occur through carryover of the first developer into the color developer in conjunction with the diffuse second exposure and would seriously affect the quality of the final dye image.

However, carryover of the first developer would be of little significance if it were comparable with the structure of the color developer and did not cause any secondary reactions in the color development bath.

If a color developer were to be used in the first and color development bath, carryover of the developer would not be a disadvantage in the event of inadequate washing or in the absence of intermediate washing, although this developer would have to be suitable for black-and-white development (reduction of the exposed silver halide nuclei to image silver) in the first development bath, in addition to which there could be no coupling of the developer oxidation product formed with the color couplers in the photographic material.

DE-OS 2 249 857 describes a reversal development process in which both a black-and-white developer and also a color developer inhibited in its color coupling activity are used in the first development bath. In a second bath, the coupling-inhibiting effects, produced for example by sulfite, ascorbic acid, etc., are eliminated so that color coupling can take place. However, the disadvantage of this process lies in the simultaneous presence of two types of developer and the resulting coordination and process difficulties.

Now, the problem addressed by the present invention was to provide a reversal development process in which washing between the first and color development baths can be eliminated without any of the above-mentioned disadvantages arising.

The present invention relates to a photographic reversal process for the production of positive photographic images by imagewise exposure of the photosensitive material containing at least one silver halide emulsion layer, black-and-white first development of the material, chemical fogging or diffuse second exposure and subsequent color development, characterized in that 1. at least one N,N-dialkyl-p-phenylenediamine derivative is used as sole developer in the first development,
2. the first development bath contains at least one compound which prevent the developer oxidation product formed during the first development from reacting with the color couplers present in the color photographic reversal material to form image dyes,
3. the silver halide emulsion layers of the photographic material have a chloride content of at least 80 mol-%.

The compounds described under 2. belong to the following classes a), b), c), d) and e):

a) sulfite, b) citrazinic acid, c) couplers containing an activated methylene group in which one hydrogen is replaced by alkyl, cycloalkyl, aryl or aralkyl and which react with the oxidation product of a color developer to form colorless reaction products, d) compounds corresponding to formula (I)

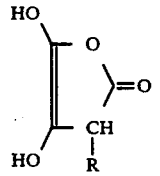

(I)

in which R represents H, $C_{1-6}$ alkyl and $C_{6-10}$ aryl optionally substituted by a hydrophilicizing group, e) hydroxylamine groups corresponding to formula II

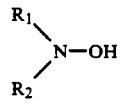

(II)

in which $R_1$ and $R_2$ represent H, $C_{1-4}$ alkyl.

Compounds corresponding to formula I, ascorbic acid and derivatives thereof, are described by F. Smith in Advances in Carbohydrate Chemistry 2, 79 (1947).

Hydrophilicizing groups are understood to be the —OH, —COOH and —$SO_3H$ groups. Preferred compounds corresponding to formula I are listed in the following:

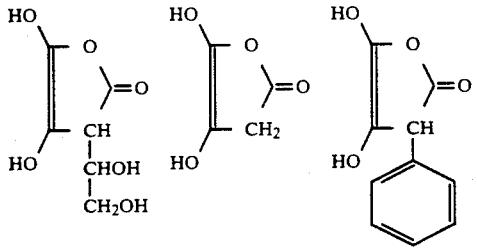

I-1 I-2 I-3

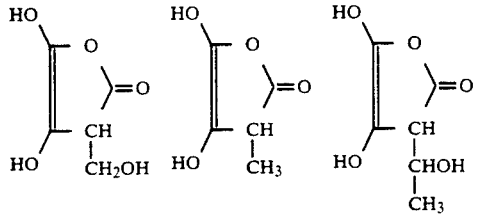

I-4 I-5 I-6

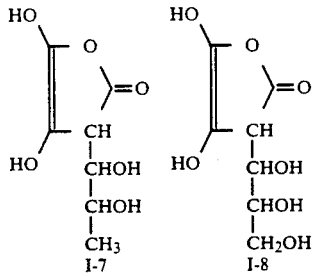

I-7 I-8

The couplers which react to form colorless reaction products, component 2*c*), may be compounds selected from the group consisting of pyrazolones, benzoyl and acetoacetic esters, benzoyl and acetoacetic acid anilides, cyanoacetyl compounds and cyanoacetamides, in which one hydrogen atom of the activated methylene group is replaced by alkyl, aryl or aralkyl.

The benzoyl and acetoacetic ester compounds in question are prepared by the methods described in Can. J. Chem. 31, page 1025 (1953).

Pyrazolone derivatives which couple to form colorless reaction products are described in DE-AS 1 155 675.

Suitable pyrazolones of the type in question correspond to general formula (III):

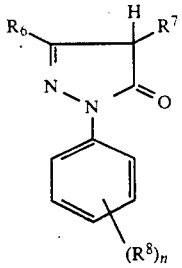

(III)

in which $R^6$ and $R^7$ represent alkyl, alkoxy, aryl, carboxy, carboxyalkyl, $R^6$ represents halogen, —CN, —$CF_3$, acylamino, sulfamoyl, alkylsulfamyl, —$SO_3H$, carboxy, carboxyalkyl, n=0–3.

The following preferred compounds are mentioned by way of example:

W-1

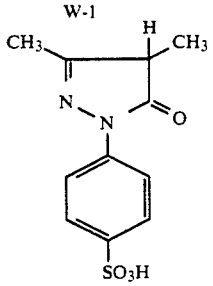

W-2

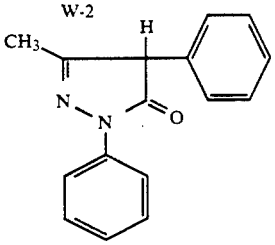

W-3

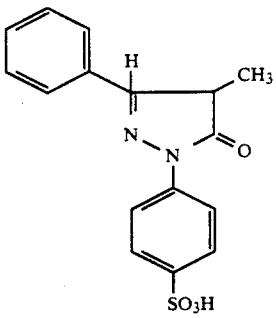

W-4

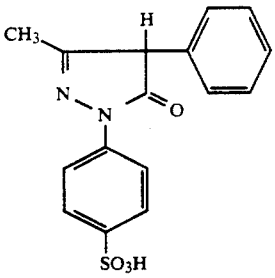

W-5

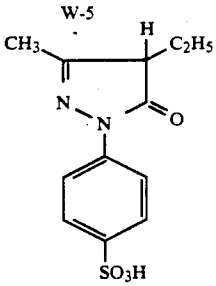

W-6

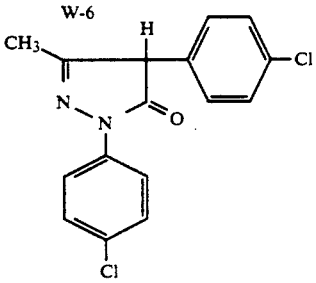

-continued

W-7 W-8

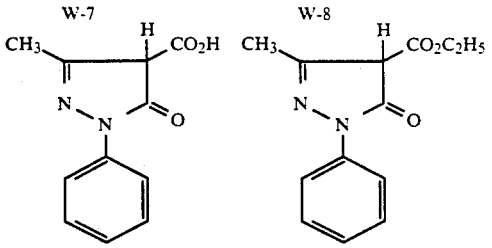

N,N-diethylhydroxylamine is mentioned as an example of a hydroxylamine derivative corresponding to formula II.

Citrazinic acid is described by E. Klingsberg in The Chemistry of Heterocyclic Compounds "Pyridine and Derivatives, Part One", page 293, Interscience Publications Inc., New York.

Through the use of a color developer for black-and-white development in the first development bath, the photographic material may be immediately transferred without washing to the following color development bath in which it is also subjected to diffuse second exposure or, alternatively, the washing time may be considerably shortened. In this case, the washing times are between 1 and 30 seconds, preferably 15 seconds, and may be used for the second exposure.

Another important requirement for rapid first development using less active color developers compared with black-and-white developers is the use of photographic material of which the silver halide emulsion layers have a chloride content of more than 80 mol-%. Chloride-rich emulsions are distinguished by particularly good developability. Preferred materials are those which have a chloride content of at least 95 mol-%, the balance to 100 mol-% consisting of bromide and/or iodide.

If, in cases where ascorbic acid or derivatives thereof are used as inhibitors to prevent dye formation in the first developer bath, protection against oxidation is preferably provided by hydroxylamines, diketones or α-hydroxyketones. Thiocyanate may then be added to the first developer to increase sensitivity, preferably in quantities of $2\cdot10^{-3}$ to $1\cdot10^{-2}$ mol/l.

First developers suitable for the process according to the invention correspond to general formula (IV)

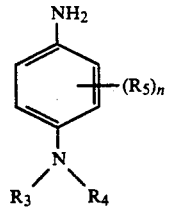

(IV)

in which $R_3$, $R_4$ represent optionally substituted $C_{1-4}$ alkyl, $C_{6-10}$ aryl and $C_{1-3}$ alkoxy, $R_5$ represents H, optionally substituted $C_{1-4}$ alkyl, $C_{6-10}$ aryl and $C_{1-3}$ alkoxy, halogen, n=1 or 2.

Primary aromatic amino developers particularly suitable for the first and color development baths are p-phenylenediamines and, in particular, N,N-dialkyl-p-phenylenediamines, in which the alkyl groups and the aromatic nucleus are substituted or unsubstituted. Examples of such compounds are N,N-diethyl-p-phenylenediamine hydrochloride, 4-N,N-diethyl-2-methyl phenylenediamine hydrochloride,4-(N-ethyl-N-2-methanesulfonylaminoethyl)-2-methyl phenylenediamine sesquisulfate monohydrate, 4-(N-ethyl-N-2-hydroxyethyl)-2-methyl phenylenediamine sulfate and 4-N,N-diethyl-2,2,-methanesulfonylaminoethyl phenylenediamine hydrochloride. CD 3 and CD 4 (see Example 1) are preferred.

The content of ascorbic acid or derivatives thereof in the first development bath is from 0.3 to 30 g/l and preferably from 2 to 15 g/l.

Sulfite is used in a quantity of 1 to 30 g/l in the first development bath and preferably in a quantity of 2 to 15 g/l.

The concentration of citrazinic acid is in the range from 1 to 25 g/l and preferably in the range from 5 to 15 g/l.

Compounds which couple to form colorless reaction products are present in the first development bath in quantities of 1 to 25 g/l and preferably in quantities of 2 to 15 g/l.

The concentrations of the hydroxylamine derivatives is in the range from 1 to 25 g/l and preferably in the range from 2 to 15 g/l.

The substances may also be combined.

The pH value in the first development bath is in the range from 6 to 9 and preferably in the range from 6.5 to 7.5.

The concentrations of the developer compounds in the first development bath are in the range from 1 to 20 g/l and preferably in the range from 4 to 12 g/l.

The bromide content of the first development bath is between 0 and 1 g/l and preferably between 0 and 0.5 g/l while the chloride content may vary between 0.3 and 6 g/l and is preferably between 0.5 and 5 g/l.

The black-and-white development of photographic reversal material carried out in the first development bath is complete in less than 60 seconds and preferably in less than 30 seconds.

In addition, it can be of advantage where the process is carried out continuously to add wetting agents and complexing agents to the developer solutions to accelerate the penetration of the solutions into the emulsion layers and to bind calcium ions from the gelatine and the water.

Suitable complexing agents for complexing calcium ions are, for example, aminopolycarboxylic acids which are well known per se. Typical examples of such aminopolycarboxylic acids are nitrilotriacetic acid, ethylenediamine tetraacetic acid (EDTA), 1,3-diamino-2-hydroxypropyl tetraacetic acid, diethylenetriamine pentaacetic acid, N,N,-bis-(2-hydroxybenzyl) -ethylenediamine-N,N,-diaceticacid,hydroxyethyl ethylenediamine triacetic acid, cyclohexane diaminotetraaacetic acid and aminomalonic acid.

Other calcium complexing agents are polyphosphates, -phosphonic acids, aminopolyphosphonic acids and hydrolyzed polymaleic anhydride, for example sodium hexametaphosphate, 1-hydroxyethane-1,1-diphosphonic acid, aminotrismethylene phosphonic acid, ethylenediamine tetramethylene phosphonic acid. 1-Hydroxyethane-1,1-diphosphonic acid also acts as a complexing agent for iron.

In addition, it is of advantage to add iron complexing agents to the developer solutions. Special iron complexing agents are, for example, 4,5-dihydroxy-1,3-benzene disulfonic acid, 5,6-dihydroxy-1,2,4-benzene trisulfonic acid and 3,4,5-trihydroxybenzoic acid.

To complex the calcium, it is preferred to use approximately 0.2 to approximately 1.8 mol of a calcium complexing agent per mol developer compound.

The iron complexing agent is used in quantities of from about 0.02 to about 0.2 mol per mol developer compound.

Other suitable constituents include optical brighteners, lubricants, for example polyalkylene glycols, surfactants, stabilizers, for example heterocyclic mercapto compounds or nitrobenzimidazole, and agents for establishing the desired pH value. In addition, the developer solution may contain less than 5 g/l benzyl alcohol, although it is preferably free from benzyl alcohol.

The ready-to-use solutions may be prepared from the individual constituents or from so-called concentrates in which the individual constituents are dissolved in much more highly concentrated form. The concentrates are formulated in such a way that a so-called replenisher may be prepared from them, i.e. a solution which has somewhat higher concentrations of the individual constituents than the ready-to-use solution, on the one hand by further dilution and addition of a starter, gives a ready-to-use solution and, on the other hand, is continuously added to an in-use developer solution to replace the chemicals consumed during development or displaced from the developer solution by overflow or by the developed material. Chloride ions need not normally be added other than to the freshly prepared developer, because chloride ions are released from the photographic material by the development.

If the developability for color development is to be or has to be obtained by diffuse second exposure in the color developer, it is of advantage to activate the diffuse second exposure at the earliest 1 second after entry of the material into the color development bath because particularly good maximum densities are obtained in this case. More particularly, the diffuse second exposure takes place 2 to 15 seconds after entry of the material into the color development bath.

In the case of single-sheet processing, this may be done simply by delayed switch-on of the lighting. In the case of dragbelt machines or roller conveyor machines, the delayed exposure may take place through a light slot or by dividing up the second development bath into a dark section and a light section. The light slot and the light/dark separation are arranged in dependence upon the speed of the material in such a way that the color development bath acts on the non-diffusion-exposed material in darkness for at least 1 second.

After development, the photographic material is stopped, bleached, fixed, washed and dried in the usual way; bleaching and fixing may be combined into a single bleaching/fixing step while washing may be replaced by a stabilizing bath. Providing the bleaching or bleaching/fixing bath is sufficiently acidic, there may even be no need for the stop bath.

EXAMPLES

A color photographic recording material suitable for the processing process according to the invention was prepared by application of the following layers in the order indicated to a layer support of paper coated on both sides with polyethylene. All the quantities shown are based on 1 $m^2$. For the silver halide applied, the corresponding quantities of $AgNO_3$ are shown.

Layer Combination

1st Layer (Substrate Layer)

0.2 g gelatine

2nd Layer (Blue-Sensitive Layer)

blue-sensitive silver halide emulsion (99.5 mol-% chloride, 0.5 mol-% bromide, mean grain diameter 0.8 μm) of 0.63 g $AgNO_3$ containing
1.38 g gelatine
0.95 g yellow coupler Y
0.29 g tricresyl phosphate (TCP)

3rd Layer (Protective Layer)

1.1 g gelatine
0.06 g 2,5-dioctyl hydroquinone
0.06 g dibutyl phthalate (DBP)

4th Layer (Green-Sensitive Layer)

green-sensitized silver halide emulsion (99.5 mol-% chloride, 0.5 mol-% bromide, mean grain diameter 0.6 μm) of 0.45 g $AgNO_3$ containing
0.08 g gelatine
0.41 g magenta coupler M
0.08 g 2,5-dioctyl hydroquinone
0.5 g DBP 0.04 g TCP 5th Layer (UV-Absorbing Layer)

1.15 g gelatine
0.6 g UV absorber corresponding to the following formula

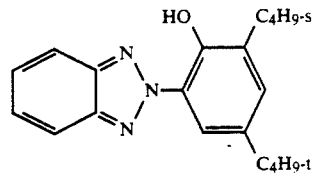

0.045 g 2,5-dioctyl hydroquinone
0.04 g TCP

6th Layer (Red-Sensitive Layer)

red-sensitized silver halide emulsion (99.5 mol-% chloride, 0.5 mol-% bromide, mean grain diameter 0.5 μm) of 0.3 g $AgNO_3$ containing
0.75 g gelatine
0.36 g cyan coupler C
0.36 g TCP 7th Layer (UV-Absorbing Layer)

0.35 g gelatine
0.15 g UV absorber as in 5th layer
0.2 g TCP

8th Layer (Protective Layer)

0.9 g gelatine
0.3 g hardener corresponding to the following formula

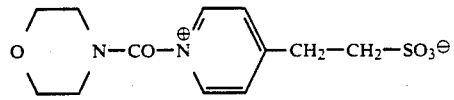

The components used have the following formulae:

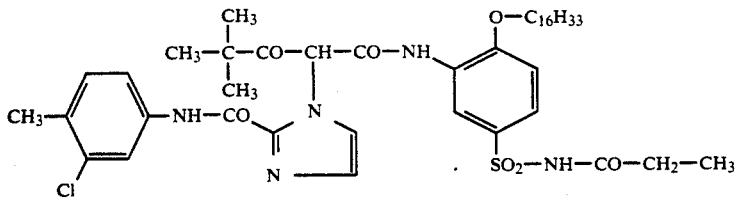

Y

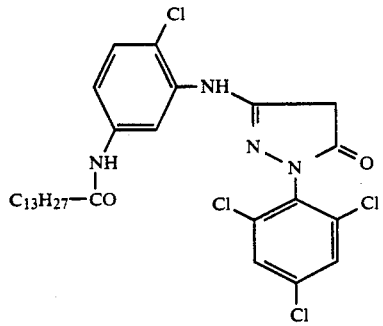

M

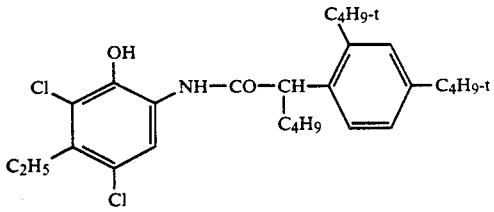

C

Samples in the form of color step wedges of the color photographic material described above were first subjected to the first development according to the invention in accordance with Examples 1 to 10 (Table 1).

The first development time was 45 seconds at 30° C.

The first developer used was

CD 3 (4-(N-ethyl-N-2-methanesulfonylaminoethyl)-2-methyl phenylenediamine sesquisulfate monohydrate) or CD 4 (4-(N-ethyl-N-2-hydroxyethyl)-2-methyl phenylenediamine sulfate monohydrate).

After the first development, the samples were washed in running water for 15 seconds or immediately introduced into the color developer (Examples a).

The diffuse second exposure took place after washing or, in the case of Examples a), 10 seconds after immersion in the color developer.

A color developer having the following composition was used for the Examples described in the following:

2 g CD 3
0.5 g sodium sulfite
19 g monopotassium phosphate
20 g potassium hydroxide
1 g potassium chloride
0.1 g ethylenediamine
make up with water to 1000 ml and adjust to pH 11.5.

CD 4 may be used instead of CD 3.

The development time in the color developer was 30 seconds at room temperature.

After brief intermediate washing for about 10 seconds, the samples were bleached/fixed in the usual way for 45 seconds at 38° C.

They were then washed for 2 minutes in running water.

In addition to this reversal development, color wedges were developed with the first developers described in the Examples, washed, fixed for 5 minutes in a commercially available fixing bath based on ammonium thiosulfate and, finally, washed for the purposes of comparison and also to determine the extent to which unwanted color coupling takes place in the first developer. Negative images are obtained and may be evaluated in regard to maximal densities and unwanted color coupling.

This is done in Table 3 while, in Table 2, the reversal images are evaluated in regard to minimal and maximal density behind the three color filters blue/green/red. In addition, the purity and saturation of the primary colors is visually evaluated.

In the following Examples, processing was carried out as described above. The particular developers used are shown.

TABLE 1

Examples 1 and 1*a*

10 g CD 4, 1 g potassium sulfite, 20 g monopotassium phosphate, make up with water to 1000 ml and adjust to pH 6.5 with potassium hydroxide.

Examples 2 and 2*a*

As 1 and 1*a*, but with pH 7.5.

Examples 3 and 3*a*

10 g CD 4, 10 g potassium sulfite, 20 g monopotassium phosphate, make up with water to 1000 ml and adjust to pH 6.5 with potassium hydroxide.

Examples 4 and 4*a*

As 3 and 3*a*, but with pH 7 5.

Examples 5 and 5*a*

As 3 and 3a, but with pH 8.5.

Examples 6 and 6*a*

As 3 and 3a, but with pH 9.5.

Examples 7 and 7*a*

10 g CD 4, 1 g potassium sulfite, 10 g white coupler W 1, 20 g monopotassium phosphate, make up with water to 1000 ml and adjust to pH 6.5 with potassium hydroxide.

Examples 8 and 8*a*

As 7 and 7a, but with pH 7.5.

Examples 9 and 9*a*

10 g CD 4, 1 g potassium sulfite, 10 g citrazinic acid, 20 g monopotassium phosphate, make up with water to 1000 ml and adjust to pH 6.5 with potassium hydroxide.

Examples 10 and 10*a*

As 9 and 9a, but with pH 7.5.

TABLE 2

| | Example No. | Reversal Processing $D_{min}$ Blue-green-red light | | | $D_{max}$ Blue-green-red light | | | Colors | Through-development | Remarks |
|---|---|---|---|---|---|---|---|---|---|---|
| Comparison | 1 | 1.42 | 0.56 | 0.37 | 2.58 | 2.40 | 2.15 | good | yellow incomplete | |
| Comparison | 1a | 1.69 | 0.61 | 0.34 | 2.57 | 2.47 | 2.31 | good | yellow incomplete | |
| Comparison | 2 | 1.58 | 1.34 | 0.85 | 2.62 | 2.45 | 2.23 | pale | yellow and magenta incomplete | |
| Comparison | 2a | 2.04 | 1.24 | 0.82 | 2.45 | 2.08 | 1.42 | pale | yellow and magenta incomplete | |
| Invention | 3 | 0.21 | 0.21 | 0.21 | 2.44 | 2.15 | 1.85 | good | good | satisfactory reversal |
| Invention | 3a | 0.26 | 0.27 | 0.31 | 2.45 | 2.18 | 2.02 | good | good | satisfactory reversal |
| Invention | 4 | 0.23 | 0.24 | 0.23 | 1.79 | 1.92 | 1.77 | red and green pale | good | poor blacks |
| Invention | 4a | 0.26 | 0.25 | 0.28 | 2.44 | 2.23 | 2.17 | good | good | satisfactory reversal |
| Comparison | 5 | 0.41 | 0.30 | 0.28 | 2.43 | 2.15 | 2.01 | red and green pale | yellow pale | |
| Comparison | 5a | 0.47 | 0.29 | 0.25 | 2.15 | 1.95 | 1.91 | red and green pale | yellow pale | |
| Comparison | 6 | 0.57 | 0.39 | 0.33 | 2.48 | 2.16 | 2.00 | red and green pale | yellow pale | |
| Comparison | 6a | 0.61 | 0.37 | 0.35 | 2.22 | 2.10 | 2.08 | red and green pale | yellow pale | |
| Invention | 7 | 0.21 | 0.19 | 0.23 | 2.55 | 2.31 | 1.99 | red and green pale | good | satisfactory reversal |
| Invention | 7a | 0.23 | 0.19 | 0.22 | 2.48 | 2.28 | 2.10 | red slightly orange | yellow pale | satisfactory reversal |
| Invention | 8 | 0.22 | 0.18 | 0.19 | 2.03 | 2.29 | 2.11 | good | good | satisfactory reversal |
| Invention | 8a | 0.21 | 0.19 | 0.21 | 2.54 | 2.39 | 2.19 | good | good | satisfactory reversal |
| Invention | 9 | 0.23 | 0.20 | 0.20 | 1.93 | 2.08 | 1.90 | good | good | satisfactory reversal |
| Invention | 9a | 0.25 | 0.22 | 0.22 | 2.14 | 2.06 | 1.73 | good | good | satisfactory reversal |
| Invention | 10 | 0.19 | 0.19 | 0.22 | 2.51 | 2.27 | 1.93 | good | good | satisfactory reversal |
| Invention | 10a | 0.22 | 0.23 | 0.26 | 2.60 | 2.47 | 2.17 | good | good | satisfactory reversal |

TABLE 3

| Example No. | Negative Processing $D_{max}$ Blue-green-red light | | | Color coupling in first developer |
|---|---|---|---|---|
| 1 | 1.40 | 1.36 | 1.25 | slight |
| 2 | 2.09 | 2.01 | 1.72 | distinct |
| 3 | 1.48 | 1.44 | 1.41 | none |
| 4 | 1.53 | 1.49 | 1.46 | none |
| 5 | 1.59 | 1.47 | 1.41 | distinct |
| 6 | 1.61 | 1.47 | 1.43 | distinct |
| 7 | 1.47 | 1.41 | 1.38 | none |
| 8 | 1.49 | 1.46 | 1.41 | none |
| 9 | 1.45 | 1.41 | 1.39 | none |
| 10 | 1.49 | 1.44 | 1.42 | none |

The desired suppression of color coupling in the first developer is adequately achieved by addition of antioxidants or competitive couplers at pH values of 6.5 to 7.5 by the additions of sulfite, white couplers and citrazinic acid. This guarantees good reversal with good D-min, D-max, clean colors and adequate full development.

Example 11

A color photographic recording material suitable for the processing process according to the invention was prepared by application of the following layers in the order indicated to a layer support of paper coated on both sides with polyethylene. All the quantities shown are based on 1 $m^2$. For the silver halide applied, the corresponding quantities of $AgNO_3$ are shown.

Layer Combination 1

1st Layer (Anti-Halo Layer)

1 g gelatine
0.1 g black colloidal silver

2nd Layer (Red-Sensitive Layer)

red-sensitized silver halide emulsion (99.5 mol-% chloride, 0.5 mol-% bromide, mean grain diameter 0 5 μm) of 0.3 g $AgNO_3$ containing
0.75 g gelatine
0.36 g cyan coupler C
0.36 g tricresyl phosphate (TCP)

3rd Layer (Protective Layer)

1.1 g gelatine
0.06 g 2,5-dioctyl hydroquinone
0.06 g dibutyl phthalate (DBP)

4th Layer (Green-Sensitive Layer)

green-sensitized silver halide emulsion (99.5 mol-% chloride, 0.5 mol-% bromide, mean grain diameter 0.6 μm) of 0.50 g $AgNO_3$ containing
1.08 g gelatine
0.41 g magenta coupler M
0.08 g 2,5-dioctyl hydroquinone
0.34 g DBP
0.04 g TCP 5th Layer (Yellow Filter Layer)

1.15 g gelatine
0.20 g yellow colloidal silver
0.05 g 2,5-dioctyl hydroquinone
0.04 g TCP 6th Layer (Blue-Sensitive Layer)

blue-sensitive silver halide emulsion (99.5 mol-% chloride, 0.5 mol-% bromide, mean grain diameter 0.8 μm) of 0.6 g $AgNO_3$ containing
1.38 g gelatine
0.85 g yellow coupler Y
0.29 g tricresyl phosphate (TCP).

7th Layer (UV-Absorbing Layer)

1.5 g gelatine
0.9 g UV absorber corresponding to the formula

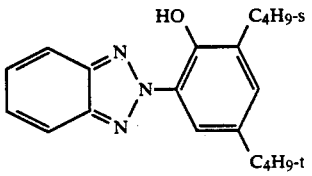

0.6 g TCP

8th Layer (Protective Layer)

0.9 gelatine
0.3 g hardener H corresponding to the following formula

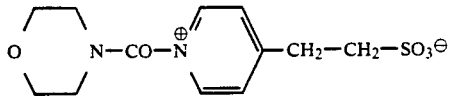

The couplers used were the same as in Examples 1 to 10.

| | | | |
|---|---|---|---|
| First Developer: | A Comparison | 60 secs. | 36° C. |
| | B Invention | 60 secs. | 36° C. |
| Washing | | 15 secs. | 22° C. |
| Fixing | | 60 secs. | 22° C. |
| Washing | | 60 secs. | 22° C. |
| Drying | | | |

The individual processing baths had the following composition:

| A) First developer (Comparison) | |
|---|---|
| Water | 800 ml |
| Ethylenediamine tetraacetic acid (EDTA) | 2 g |
| Hydroxyethane diphosphonic acid (HEDP); 60% by weight | 0.5 ml |
| Sodium chloride | 2 g |
| N,N-diethyl hydroxylamine, 85% by weight | 5 ml |
| Sodium hydrogen carbonate | 20 g |
| 4-(N-ethyl-N-2-hydroxyethyl)-2-methyl-phenylenediamine sulfate monohydrate (CD 4) 5% by weight | 100 ml |

adjust to pH 6.5 with KOH or $H_2SO_4$ and then make up with water to 1 liter.

B) First Developer (Invention)
As A, but with 4 g/l ascorbic acid added in accordance with the invention.

| Fixing bath: | |
|---|---|
| Water | 900 ml |
| Sodium disulfite | 10 g |
| Ammonium thiosulfate | 80 g |

ph 5, make up with water to 1 liter.

After processing of the samples in the different baths, density measurements were carried out with a Macbeth densitometer. The following $D_{min}$ and $D_{max}$ values were obtained:

TABLE 4

| | $D_{min}$ | $D_{max}$ |
|---|---|---|
| A: First Developer (Comparison) | 0.08 | 0.33 |
| B: First Developer (Invention) | 0.08 | 1.50 |

Using the first developer according to the invention, it was possible to increase the silver density as a measure of developer activity several times. In conjunction with the chloride-rich and, hence, readily developable emulsions, a color developer with ascorbic acid added develops sufficient activity for the first development phase of the reversal process.

Example 12

This Example demonstrates the sensitometric effects arising out of direct transfer of the exposed photographic recording material (as in Example 11) from the first developer to the second developer by comparison with a processing sequence in which washing is carried out after the first development to wash out the constituents of the first developer.

Processing takes place as follows:

| | | |
|---|---|---|
| A: | First development | 60 secs. 36° C. |
| | Washing | 120 secs. 22° C. |
| | Second developer | 8 secs. 36° C. |
| | Diffuse second exposure | |
| | Second development | 30 secs. 36° C. |
| | Washing | 30 secs. 22° C. |
| | Bleaching/fixing bath | 90 secs. 36° C. |
| | Washing | 120 secs. 22° C. |
| | Drying | |
| B: | First development | 60 secs. 36° C. |
| | Removal of surplus developer | |
| | Second developer | 8 secs. 36° C. |
| | Diffuse second exposure | |
| | Second development | 30 secs. 30° C. |
| | Washing | 30 secs. 22° C. |
| | Bleaching/fixing bath | 90 secs. 36° C. |
| | Washing | 120 secs. 22° C. |
| | Drying | |

The processing baths had the following composition:

| First Developer (for conventional reversal) | |
|---|---|
| Water | 900 ml |
| EDTA | 2 g |
| HEDP, 60% by weight | 0.5 ml |
| Sodium sulfite | 7 g |
| Sodium chloride | 2 g |
| Hydroquinone sulfonic acid, potassium salt | 15 g |
| 1-Phenyl-3-pyrazolidone (phenidone) | 0.3 g |
| Potassium carbonate | 10 g |

Adjust to pH 9 with KOH or $H_2SO_4$, make up with water to 1 liter.

| Second Developer | |
|---|---|
| Water | 900 ml |
| EDTA | 2 g |
| HEDP, 60% by weight | 0.5 ml |
| Sodium chloride | 1 g |
| N,N-diethylhydroxylamine, 85% by weight | 5 ml |
| 4-(N-ethyl-N-2-methanesulfonylaminoethyl)-2-methyl phenylenediamine sesquisulfate monohydrate (CD 3), 50% by weight | 8 ml |
| Potassium carbonate | 25 g |

Adjust to pH 10 with KOH or $H_2SO_4$, make up with water to 1 liter.

| Bleaching/fixing bath: | |
|---|---|
| Water | 800 ml |
| EDTA | 4 g |
| Ammonium thiosulfate | 100 g |
| Sodium sulfite | 15 g |
| Ammonium-iron-EDTA complex | 60 g |
| 3-Mercapto-1,2,4-triazole | 2 g |

Adjust to pH 7.3 with ammonia or acetic acid, make up with water to 1 liter.

The reversal materials processed by the different processes (A: with washing between first and second developer; B: without washing between first and second developer) and exposed beforehand with a step wedge (as in Example 11) were evaluated by sensitometry.

TABLE 5

| | | Filter | | |
|---|---|---|---|---|
| | | Blue | Green | Red |
| A (with washing) | $D_{min}$ | 0.17 | 0.13 | 0.12 |
| | $D_{max}$ | 2.36 | 2.40 | 1.80 |
| B (without washing) | $D_{min}$ | 0.22 | 0.14 | 0.11 |
| | $D_{max}$ | 1.90 | 1.73 | 1.29 |

Direct transfer to the second developer from a first developer of typical composition produces unevenly developed images with considerably reduced $D_{max}$ values by comparison with the process in which washing was carried out between first and second development.

Example 13

The following Example demonstrates the sensitometric effect arising out of direct transfer of the exposed photographic reversal material from a first developer according to the invention to the second developer by comparison with a processing sequence in which washing is carried out between first and second developer.

A step wedge is exposed onto the photographic material described in Example 11. The processing sequence corresponds to that of Example 12.

Test sequence A involves intermediate washing; test sequence B involves no intermediate washing.

The individual baths have the following composition:

| First Developer (Invention) | |
|---|---|
| Water | 800 ml |
| EDTA | 2 g |
| HEDP, 60% by weight | 0.5 ml |
| Sodium chloride | 2 g |
| N,N-diethyl hydroxylamine, 85% by weight | 5 ml |
| Ascorbic acid | 4 g |
| Sodium hydrogen carbonate | 20 g |
| CD 4; 5% by weight aqueous solution | 100 ml |

Adjust to pH 6.5 with KOH or $H_2SO_4$, make up with water to 1 liter.

Second Developer and Bleaching/Fixing Bath

Composition as in Example 12.

The sensitometric results of the densitometer measurements are shown in Table 6:

TABLE 6

| | | | Filter | | |
|---|---|---|---|---|---|
| | | | Blue | Green | Red |
| 3A | (with intermediate washing) | $D_{min}$ | 0.23 | 0.18 | 0.15 |
| | (Comparison) | $D_{max}$ | 2.78 | 2.78 | 2.67 |
| 3B | (without intermediate washing) | $D_{min}$ | 0.25 | 0.18 | 0.13 |
| | (Invention) | $D_{max}$ | 2.71 | 2.71 | 2.62 |

This Example clearly shows that the process according to the invention eliminates the need for washing between first and second developer without any disadvantages arising in the form of reduced maximal densities and unevenly developed images (see Example 12).

Example 14

A color photographic material according to Example 1 is processed by the following processing variants I, II and III. It can be seen from the maximal densities that it is of advantage to carry out the diffuse second exposure after a delay of 5 seconds rather than immediately on entry into the color developer.

| Processing variant I | |
|---|---|
| First developer | 45 secs. |
| Washing | 45 secs. |
| Washing with second exposure | 45 secs. |
| Color development | 45 secs. |
| Bleaching/fixing | 45 secs. |
| Washing | 90 secs. |

Processing Variant II

As I, but with no washing between first and second developer and with second exposure immediately on transfer from the first to the color developer.

Processing Variant III

As I, but with no washing between first and color developer, beginning of second exposure 5 seconds after immersion in the color developer.

| Maximal densities | y | mg | cy |
|---|---|---|---|
| Variant I | 254 | 240 | 220 = reference |
| II | 237 | 222 | 201 = comparison |
| III | 249 | 241 | 224 = invention |

We claim:

1. A photographic reversal process for the production of positive photographic images by imagewise exposure of the photosensitive material containing at least one blue-sensitive silver halide layer containing a yellow coupler, at least one green-sensitive silver halide layer containing a magenta coupler and at least one red-sensitive silver halide layer containing a cyan coupler, black-and-white first development of the material, chemical fogging or diffuse second exposure and subsequent color development, characterized in that a) at least one N,N-dialkyl-p-phenylenediamine derivative is used as sole developer in the first development, b) the first development bath contains at least one compound which prevents the developer oxidation product formed during the first development from reacting with the color couplers present in the color photographic reversal material to form image dyes, c) the pH value in the first development bath is in the range of from 6.5 to 7.5 d) the silver halide emulsion layers of the photographic material have a chloride content of at least 80 mol-%.

2. A process as claimed in claim 1, characterized in that the first development bath contains at least one compound that prevents the developer oxidation product formed during the fist development from reacting with the color couplers and belonging to the following classes a), b), c), d) and e):

a) sulfite, b) citrazinic acid, c) couplers containing an activated methylene group in which one hydrogen is replaced by alkyl, cycloalkyl, aryl or aralkyl and which react with the oxidation product of a color developer to form colorless reaction products, d) compounds corresponding to formula (I)

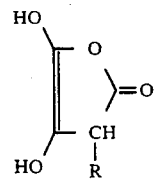

(I)

in which R R represents H, $C_1$–$C_6$ alkyl and $C_{6-10}$ aryl optionally substituted by a hydrophilicizing group, e) hydroxylamine groups corresponding to formula II

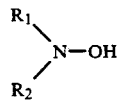

(II)

in which $R_1$ and $R_2$ represent H, $C_{1-4}$ alkyl.

3. A process as claimed in claim 2 wherein the compound that prevents the developer oxidation product formed during the first development from reacting with the color couplers in a sulfite in a quantity of 2 to 15 g/l or a citrazinic acid in a quantity of 1 to 25 g/l or a compound coupling to form colorless reaction products in a quantity of 1 to 25 g/l or a compound corresponding to formula (I) in a quantity of 0.3 to 30 g/l or a hydroxylamine derivative in a quantity of 1 to 25 g/l.

4. A process as claimed in claim 1, characterized in that no washing is carried out between first and color development.

5. A process as claimed in claim 1, characterized in that washing is carried out between first development and color development, the washing times being between 1 and 30 seconds.

6. A process as claimed in claim 1, characterized in that the compound that prevents the developer oxidation product formed during the first development from reacting with the color couplers corresponds to the general formula (III)

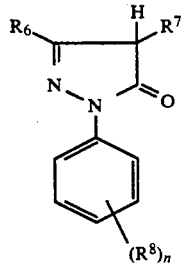

(III)

7. A process as claimed in claim 1, characterized in that the N,N-dialkyl-p-phenylenediamine derivative in the first development bath corresponds to formula (IV)

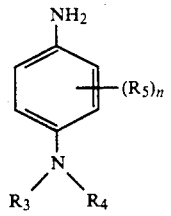

(IV)

in which $R_2$ and $R_4$ represent optionally substituted $C_{1-4}$ alkyl, $C_{6-10}$ aryl and $C_{1-3}$ alkoxy, $R_3$ represents H, optionally substituted $C_{1-4}$ alkyl, $C_{6-10}$ aryl and $C_{1-3}$ alkoxy, halogen, n=1 or 2.

8. A process as claimed in claim 1, characterized in that the N,N-dialkyl-p-phenylenediamine derivatives correspond to formula (V) and/or (VI)

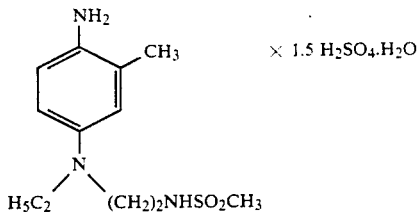

(V)

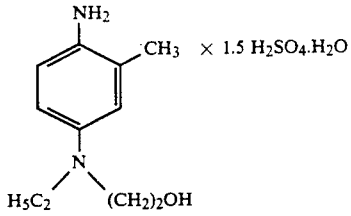

(VI)

9. A process as claimed in claim 8, characterized in that the developers corresponding to formula (V) and/or formula (VI) are present in the first developer bath in a quantity of from 1 to 20 g/l.

10. A process as claimed in claim 1, wherein said first development bath contains bromide in a content of from 0 to 1.0 g/l and chloride in a content of from 0.3 to 0.6 g/l.

* * * * *

UNITED STATES PATENT AND TRADEMARK OFFICE

CERTIFICATE OF CORRECTION

PATENT NO. :5,110,715
DATED :May 5, 1992
INVENTOR(S) :Ubbo Wernicke, et. al.

It is certified that error appears in the above-indentified patent and that said Letters Patent is hereby corrected as shown below:

In column 2, lines 50-57 formula (I) should read as follows:

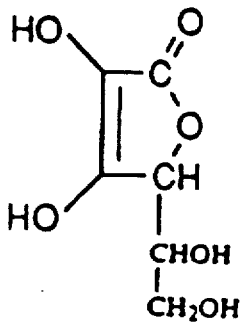

I-1

UNITED STATES PATENT AND TRADEMARK OFFICE

CERTIFICATE OF CORRECTION

PATENT NO. : 5,110,715
DATED : May 5, 1992
INVENTOR(S) : Ubbo wernicke, et. al.

It is certified that error appears in the above-indentified patent and that said Letters Patent is hereby corrected as shown below:

In column 3, lines 12-23, formula I-1 through I-3 should be as follows:

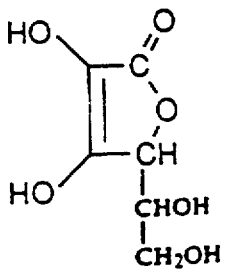

I-1

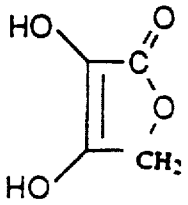

I-2

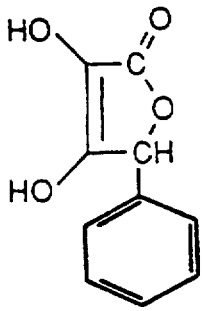

I-3

UNITED STATES PATENT AND TRADEMARK OFFICE

CERTIFICATE OF CORRECTION

PATENT NO. : 5,110,715
DATED : May 5, 1992
INVENTOR(S) : Ubbo Wernicke, et. al.

It is certified that error appears in the above-indentified patent and that said Letters Patent is hereby corrected as shown below:

In column 3, lines 24-34, formula I-4 through I-6 should be as follows:

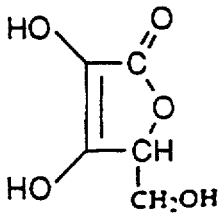

I-4

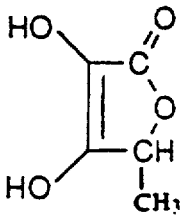

I-5

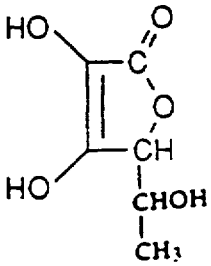

I-6

UNITED STATES PATENT AND TRADEMARK OFFICE

CERTIFICATE OF CORRECTION

PATENT NO. : 5,110,715

DATED : May 5, 1992

INVENTOR(S) : Ubbo Wernicke, et. al.

It is certified that error appears in the above-indentified patent and that said Letters Patent is hereby corrected as shown below:

In column 3, lines 35-46, formula I-7 through I-8 should be as follows:

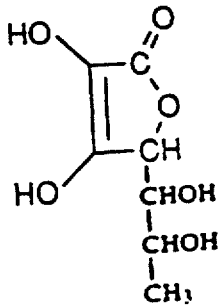

I-7

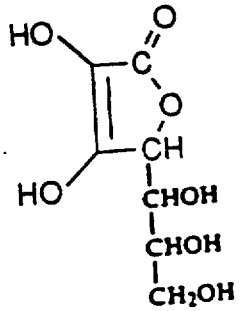

I-8

UNITED STATES PATENT AND TRADEMARK OFFICE

CERTIFICATE OF CORRECTION

PATENT NO. : 5,110,715
DATED : May 5, 1992
INVENTOR(S) : Ubbo Wernicke, et. al.

It is certified that error appears in the above-indentified patent and that said Letters Patent is hereby corrected as shown below:

In column 18, lines 1-9, (in claim 2), formula (I) should read as follows:

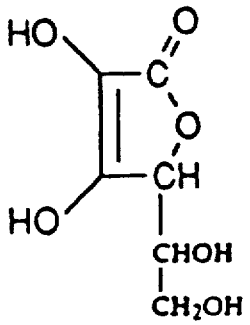

Signed and Sealed this

Seventh Day of March, 1995

*Attest:*

BRUCE LEHMAN

*Attesting Officer*

*Commissioner of Patents and Trademarks*